United States Patent [19]

Karg et al.

[11] Patent Number: 5,009,148

[45] Date of Patent: Apr. 23, 1991

[54] VEHICLE AIR EXCHANGE ACCORDING TO PASSENGER LOAD

[75] Inventors: Kenneth A. Karg; Carl K. Hvozda; Robert N. Neddermeyer; Alexander Feld, all of Pittsburgh, Pa.

[73] Assignee: AEG Westinghouse Transportation Systems, Inc., Pittsburgh, Pa.

[21] Appl. No.: 444,787

[22] Filed: Dec. 1, 1989

[51] Int. Cl.[5] ..... B61D 27/00

[52] U.S. Cl. ..... 98/10; 98/14

[58] Field of Search ..... 98/2.01, 10, 14; 165/42, 43, 44

[56] References Cited

U.S. PATENT DOCUMENTS

| | | | |
|---|---|---|---|
| 3,861,282 | 1/1975 | Scherenberg et al. | 98/10 X |
| 4,219,071 | 8/1980 | Careglio et al. | 165/23 |
| 4,272,015 | 6/1981 | Huvser | 165/43 X |

*Primary Examiner*—Harold Joyce
*Attorney, Agent, or Firm*—Spencer & Frank

[57] ABSTRACT

A system for controlling the amount of fresh air being introduced into a people mover vehicle. A variable flow exchange is provided based on the number of passengers in the vehicle thus controlling the amount of positive ventilation in relation to the passenger load. The people mover vehicle is electrically powered and, after the people mover vehicle leaves a station, the electric motor current is monitored and the vehicle speed is monitored. The motor current during the time that the vehicle speed is between about two miles per hour and about five miles per hour is proportional to the passenger load and, therefore, the ventilation requirements can be determined, and the appropriate amount of positive ventilation supplied, based upon the electric motor current monitored when the vehicle velocity is within the aforementioned range.

10 Claims, 1 Drawing Sheet

VEHICLE AIR EXCHANGE ACCORDING TO PASSENGER LOAD

BACKGROUND OF THE INVENTION

This invention relates to a vehicle air exchange system, i.e., a ventilating system, and more particularly, to such a system which operates economically and efficiently by providing the necessary amount of ventilation depending upon the number of passengers in a vehicle. The present invention is an adjunct to the heating and air conditioning systems heretofore used in connection with such vehicles.

There is a need for controlling the amount of fresh air provided to an electrically operated vehicle such as a people mover vehicle, train, subway car or the like. The American Society of Heating, Refrigerating and Air Conditioning Engineers has established ventilation standards for acceptable indoor air quality (ASHRAE standard 62-1981 suggests 8.5 cubic meters per hour, per person).

Prior to the present invention, ventilation of people mover vehicles was typically based upon the maximum rated passenger load. Of course, since the vehicles were not always fully occupied, much of the energy used to ventilate the vehicle was wasted because much of the ventilation was unnecessary. Furthermore, when considered in conjunction with heating and air conditioning, there was an even more substantial waste of energy since fresh air or outside air was being brought into the vehicle and thereafter unnecessarily heated or cooled.

SUMMARY OF THE INVENTION

The present invention provides for variable positive ventilation, that is, a variable ventilating air exchange volume, based upon the number of passengers in a people mover vehicle.

The present invention provides for positive ventilation in relation to the passenger load on board the vehicle by controlling the operation of fans which draw fresh air into and thereafter circulate the air through a people mover vehicle.

In an alternate embodiment, the present invention provides for positive ventilation in relation to the passenger load on board the vehicle by controlling the speed of one or more variable speed fans in proportion to the number of people in the vehicle.

We have discovered that in a people mover vehicle of the type wherein electrical power is supplied to a traction motor which powers the vehicle, the electrical current through the power supply which powers the traction motor is directly proportional to the passenger load in the vehicle under specific conditions. Stated alternately, the electrical current through the power supply which powers the traction motor is directly proportional to the mass of the vehicle under specific conditions. The specific conditions are first, that the vehicle is moving (e.g., accelerating) on level ground and second that the velocity of the vehicle is between about two miles per hour to about five miles per hour. We have further discovered that this condition may be conveniently monitored at each station after the vehicle has come to a complete stop. Thus, by sensing the motor current, a load (mass) indication may be obtained and a signal generated in response to which signal the ventilation may be controlled.

BRIEF DESCRIPTION OF THE DRAWINGS

The foregoing benefits and advantages of the present invention, together with other advantages which may be attained by its use, will become more apparent upon reading the detailed description of the invention taken in conjunction with the drawings.

In the drawings, wherein like reference numerals identify corresponding components.

DETAILED DESCRIPTION OF THE INVENTION

Figure 1:
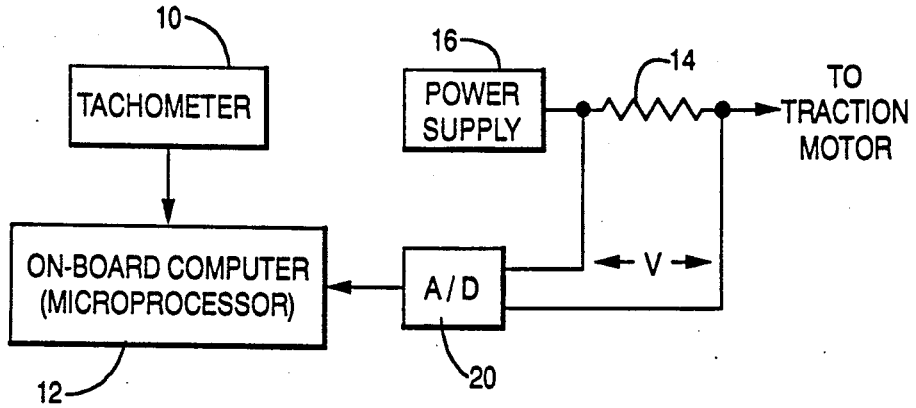
FIG. 1 is a block diagram illustration of determining the passenger load in a people mover vehicle according to the principles of the present invention.

FIG. 1 illustrates, in block diagram form, the system of the present invention for determining the passenger load in an electrically powered people mover vehicle. Conventional people mover vehicles of the type under consideration typically include an on-board computer which, together with various sensors, control vehicle speed, starting, stopping, door opening and door closing cycles, heating and air conditioning. Using such conventional, already existing equipment there is provided a tachometer 10 which is connected to the traction wheel of the vehicle and which provides, via a toothed output gear, a number of rotations per minute which corresponds to the vehicle speed. Since the output of the tachometer is taken from a rotating toothed gear, the tachometer output signal which is proportional to the speed of the people mover vehicle is, in fact, a digital signal which has been heretofore used as an indication of vehicle speed as an input to an on-board computer 12. Prior art on-board computers for people mover vehicles have been Intel 8086-based microprocessors.

The people mover vehicle has traction motors which are electrically powered via drive motors. The electrical current to the traction motors has typically been monitored by placing a small resistance in series with the motor and measuring the voltage drop across the resistor. With reference to FIG. 1, this is illustrated diagrammatically as measuring the voltage drop across a resistor 14 which is connected in series with an electric motor 16. The voltage V across the resistor 14 which, of course, is proportional to the current through the resistor, is an analog signal which is converted to a digital signal by an A/D converter 20. The output of the A/D converter 20 is also supplied to the onboard computer.

Under control of the on-board computer 12, the motor current is sensed during the time interval that the vehicle is travelling at the rate of between about 2 miles per hour to about 5 miles per hour, with about five miles per hour being the preferred vehicle velocity. Since the motor current is proportional to the vehicle load, the microprocessor includes a table lookup which determines the load according to the following chart which is stored in the microprocessor memory as part of the lookup table:

| Passenger Load (kg) | Number of Passengers |
|---|---|
| 0-1160 | 1-16 |
| 1160-2320 | 17-32 |
| 2320-3480 | 33-48 |
| 3480-4640 | 49-64 |
| 4640-5800 | 65-80 |
| 5800-6960 | 81-96 |
| ABOVE 6960 | ABOVE 96 |

Based upon the motor current, which is proportional to the number of passengers, and with a desired ventilation of 17 cubic meters per hour per passenger (twice the ASHRAE standard), the ventilation requirement is established as follows:

| Passengers | Ventilation/Cubic M/Hr |
|---|---|
| 1-16 | 272 |
| 17-32 | 544 |
| 33-48 | 816 |
| 49-64 | 1088 |
| 65-80 | 1360 |
| 81-96 | 1632 |
| ABOVE 96 | 1632 |

Figure 2:
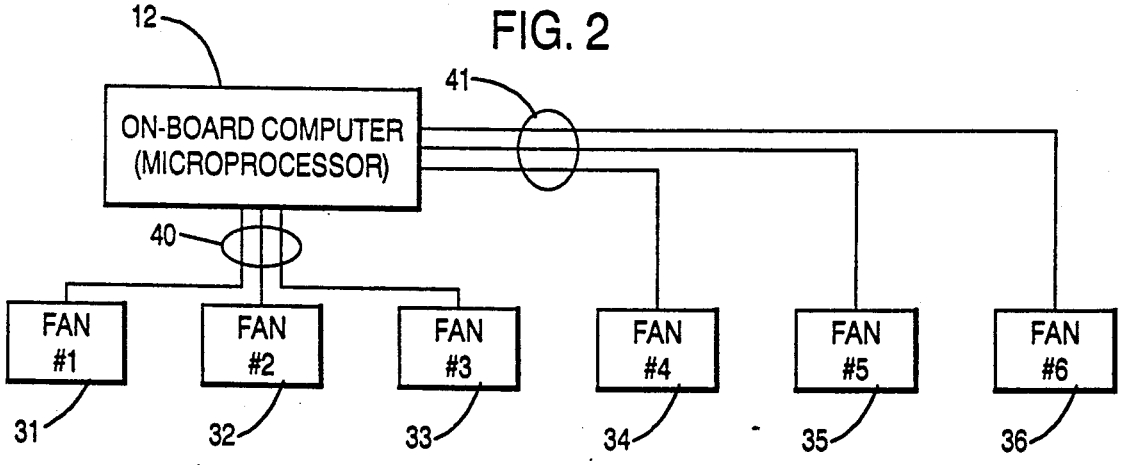
FIG. 2 is a block diagram of a first system for controlling the ventilation of a vehicle in proportion to the number of passengers in the vehicle.

Referring next to FIG. 2, a first system is illustrated for controlling the ventilation of the vehicle in proportion to the passenger load. The system of FIG. 2 contemplates the provision of six fans in the people mover vehicle, the six fans being identified by reference numerals 31-36, respectively. Control signals are provided by the on-board computer 12 to the fans via fan control lines 40, 41, such as relays, to operate the fans according to the following chart, based upon the number of passengers in the vehicle.

| Passengers | Fans 1-3 | Fans 4-6 |
|---|---|---|
| 1-16 | one-third speed (ON) | OFF |
| 17-32 | two-thirds speed (ON) | OFF |
| 33-48 | OFF | ON (full speed) |
| 49-64 | one-third speed (ON) | ON (full speed) |
| 65-80 | two-thirds speed (ON) | ON (full speed) |
| 81-96 | full speed (ON) | ON (full speed) |
| ABOVE 96 | full speed (ON) | ON (full speed) |

In connection with the foregoing, it must be appreciated that whatever fans are operating at any given time should be operating at the same speed to prevent ventilating air from being drawn in by a faster rotating fan and expelled through a slower rotating fan. It should also be understood that according to the chart illustrating the operation of the fans, that the fans are considered as being arranged in two banks; a first bank of fans 1, 2 and 3 and a second bank of fans 4, 5 and 6. According to the principles of the present invention for a people mover vehicle of the passenger capacity under consideration, each of the fans 31-36 may be a ThermaPro-V Major DC variable speed fan manufactured by Comair-Rotron of Saugerties, New York.

Figure 3:
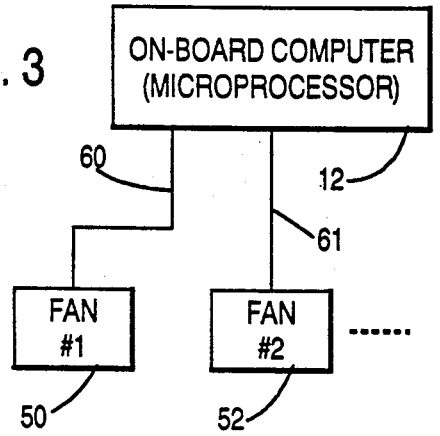
FIG. 3 is a block diagram of a second system for controlling the ventilation in proportion to the number of passengers in a vehicle.

Referring next to FIG. 3, an alternate embodiment of the present invention is illustrated wherein one or more variable speed fans 50, 52 are provided for an individual people mover vehicle. The speed of the fans are controlled in proportion to the ventilation requirements via control lines 60, 61. For example, if each fan is operable to draw between 136 and 816 cubic meters per hour, then the fans may be selectively controlled to achieve the desired ventilation according to the aforementioned chart. By way of illustration, with 1-16 people in the vehicle, each of the two fans could be operated at low speed, providing 136 cubic meters per hour of ventilation per fan, or one variable speed fan could be operated at a higher speed to provide 272 cubic meters per hour of ventilation, and the other variable speed fan not operated. More than two variable speed fans may be provided. It must be understood, however, that all variable speed fans which are operating at a given time are, in fact, operating at the same speed to avoid fresh air being drawn into the vehicle by the faster rotating fan and thereafter being forced out of the vehicle through a more slowly rotating fan.

The 8086 based processor may be programmed to control the fan operation in PLM 86 language. The software program functions to adjust the fan speed (as well as the number of fans which are operating) when the velocity of the people mover vehicle reaches about 5 miles per hour after first having come to a complete stop at a station. It is presumed that the vehicle will move on level ground after leaving the station at least for a sufficient distance to enable the 5 mile per hour speed to be achieved. Since the vehicle doors open and close at the station, the program recomputes passenger load the first time the 5 mile per hour speed has been reached after a door open-door close cycle has been controlled by the on-board computer. Thereafter, although the vehicle may be at a speed of between about 2 to about 5 miles per hour on several occasions before reaching the next station, the amount of ventilation which is being provided is not changed as it is presumed, in the absence of a door open-door close cycle, that there has been no change in the number of passengers in the people mover vehicle.

It should be further understood that the present invention is directed to fresh air ventilation or fresh air flow in a people mover vehicle. Conventional heating and cooling techniques are used in conjunction with the fresh air ventilation to maintain the desired people mover vehicle temperature which is 23° C.

The foregoing is a complete description of the present invention. Numerous changes may be made without departing from the spirit and scope of the present invention. The present invention, therefore, should be limited only by the scope of the following claims.

What is claimed is:

1. In a ventilation system for a vehicle powered by an electric motor, the improvement comprising:

means for detecting the velocity of the vehicle;

means for detecting the current of the electric motor supplying power to the vehicle;

at least one variable speed fan; and means connected to the variable speed fan for controlling the speed of the fan in proportion to the electric motor current detected when the velocity of the vehicle reaches a preselected range.

2. The invention as defined in claim 1 wherein the system includes at least two variable speed fans connected to the fan speed controlling means.

3. The invention as defined in claim 2 wherein the variable speed fans are operated at the same speed.

4. The invention as defined in claim 1 wherein said preselected range is between about two miles an hour and about five miles an hour.

5. In a ventilation system for a vehicle powered by an electric motor, the improvement comprising:

means for detecting the velocity of the vehicle;

means for detecting the current of the electric motor supplying power to the vehicle;

at least two fans;

means connected to the fans for selectively operating the fans in proportion to the electric motor current detected when the velocity of the vehicle is within a preselected range.

6. The invention as defined in claim 5, wherein said preselected range is between about two miles per hour and about five miles per hour.

7. The invention as defined in claim 5 wherein at least two fans are simultaneously operated at the same speed.

8. The invention as defined in claim 5, wherein the ventilation system includes six fans.

9. The invention as defined in claim 5, wherein the ventilation system includes a plurality of fans connected in two groups each having a substantially equal number of fans.

10. A method of operating a ventilation system for a vehicle based upon the number of passengers in the vehicle, the ventilation system including at least one fan, the vehicle powered by an electric motor, the method comprising the steps of:

detecting the velocity of the vehicle;

detecting the magnitude of the electric motor current; and selectively operating the fans in proportion to the magnitude of the electric motor current detected the first time that the vehicle velocity is within a preselected range after the vehicle has come to a complete stop.

* * * * *